US008046899B2

(12) United States Patent
Burch

(10) Patent No.: US 8,046,899 B2
(45) Date of Patent: Nov. 1, 2011

(54) UNIVERSAL SHAFT AND HEAD CONNECTOR

(75) Inventor: Eric Burch, Rockford, IL (US)

(73) Assignee: Club-Conex, Inc., Rockford, IL (US)

( * ) Notice: Subject to any disclaimer, the term of this patent is extended or adjusted under 35 U.S.C. 154(b) by 0 days.

(21) Appl. No.: 12/971,192

(22) Filed: Dec. 17, 2010

(65) Prior Publication Data

US 2011/0086724 A1 Apr. 14, 2011

Related U.S. Application Data

(62) Division of application No. 12/353,304, filed on Jan. 14, 2009, now Pat. No. 7,857,709.

(60) Provisional application No. 61/020,793, filed on Jan. 14, 2008.

(51) Int. Cl.
*B23P 11/00* (2006.01)
*A63B 53/02* (2006.01)

(52) U.S. Cl. ..... 29/525.02; 473/307

(58) Field of Classification Search ..... 29/525.02, 29/525.01, 525.13, 464, 466, 467, 469, 510, 29/511; 473/307, 288, 294, 296, 298, 299; 403/338, 374.3
See application file for complete search history.

(56) References Cited

U.S. PATENT DOCUMENTS 682,960 A 9/1901 Slazenger
1,543,636 A 6/1925 Williamson
1,565,069 A 12/1925 Edwards
1,585,907 A 5/1926 Miller
2,231,847 A 2/1941 Dickson et al.
2,463,053 A 3/1949 Pritchard
2,464,850 A 3/1949 Crawshaw
3,170,691 A 2/1965 Pritchard
3,947,041 A 3/1976 Barber
4,340,227 A 7/1982 Dopkowski
(Continued)

FOREIGN PATENT DOCUMENTS

WO WO 2004/000424 12/2003
(Continued)

OTHER PUBLICATIONS

2004 PGA Merchandise Show News (magazine); Jan. 31, 2004; cover and pp. 40-41; Publisher: GGRW Inc., Norwalk, CT.

(Continued)

*Primary Examiner* — John C Hong
(74) *Attorney, Agent, or Firm* — Reinhart Boerner Van Deuren P.C.

(57) ABSTRACT

A connector for releasably securing a shaft and a head having a hosel with a bore of standard size. The connector includes a shaft adapter, a hosel adapter, and a compression nut. The shaft adapter has a shaft bore sized to receive the shaft, a first threaded coupling member, and a axial shaft. The hosel adapter has a hosel bore and a main body portion. The hosel bore is sized to receive the axial shaft. The compression nut has a second coupling member. The shaft is secured within the shaft bore and the main body portion is secured within the bore of the hosel using an adhesive and the axial shaft is inserted within the hosel bore. Thereafter, the compression nut is rotated to couple the first and second coupling members together thereby securing the shaft and head together without the shaft being received within the bore of the hosel.

19 Claims, 2 Drawing Sheets

U.S. PATENT DOCUMENTS

| | | | | |
|---|---|---|---|---|
| 5,137,275 | A | 8/1992 | Nelson | |
| 5,390,921 | A | 2/1995 | De Ruyter | |
| 5,863,260 | A | 1/1999 | Butler, Jr. et al. | |
| 5,951,411 | A | 9/1999 | Wood et al. | |
| 6,039,659 | A | 3/2000 | Hamm | |
| 6,343,999 | B1 | 2/2002 | Murtland et al. | |
| D477,487 | S | 7/2003 | Chaney et al. | |
| D477,955 | S | 8/2003 | Chaney et al. | |
| D478,140 | S | 8/2003 | Burrows | |
| D478,233 | S | 8/2003 | Chaney et al. | |
| D478,951 | S | 8/2003 | Burrows | |
| D482,087 | S | 11/2003 | Burrows | |
| D482,089 | S | 11/2003 | Burrows | |
| D482,090 | S | 11/2003 | Burrows | |
| D482,094 | S | 11/2003 | Burrows | |
| D482,419 | S | 11/2003 | Burrows | |
| D482,420 | S | 11/2003 | Burrows | |
| D483,826 | S | 12/2003 | Burrows | |
| D484,208 | S | 12/2003 | Burrows | |
| 6,692,375 | B2 | 2/2004 | Abe | |
| 6,746,341 | B1 | 6/2004 | Hamric, Jr. et al. | |
| 6,797,106 | B2 | 9/2004 | Lenhof et al. | |
| 6,890,269 | B2 | 5/2005 | Burrows | |
| 7,083,529 | B2 | 8/2006 | Cackett et al. | |
| 7,207,897 | B2 | 4/2007 | Burch et al. | |
| 7,300,359 | B2 * | 11/2007 | Hocknell et al. | 473/309 |
| 7,326,126 | B2 * | 2/2008 | Holt et al. | 473/307 |
| 7,335,113 | B2 * | 2/2008 | Hocknell et al. | 473/307 |
| 7,427,239 | B2 * | 9/2008 | Hocknell et al. | 473/307 |
| 7,704,158 | B2 * | 4/2010 | Burrows | 473/288 |
| 2003/0050132 | A1 | 3/2003 | Wilbur | |
| 2003/0153398 | A1 | 8/2003 | Tseng | |
| 2003/0181255 | A1 | 9/2003 | Ho | |
| 2004/0018886 | A1 | 1/2004 | Burrows | |
| 2004/0018887 | A1 | 1/2004 | Burrows | |
| 2005/0176521 | A1 | 8/2005 | Burch et al. | |
| 2007/0017334 | A1 | 1/2007 | Hebestreit et al. | |
| 2007/0173344 | A1 | 7/2007 | Burch | |
| 2008/0254908 | A1 | 10/2008 | Bennett et al. | |
| 2009/0181792 | A1 | 7/2009 | Burch | |

FOREIGN PATENT DOCUMENTS

| | | |
|---|---|---|
| WO | WO 2004/000425 | 12/2003 |
| WO | WO 2004/009181 | 1/2004 |
| WO | WO 2004/009186 | 1/2004 |

OTHER PUBLICATIONS

Henry-Griffitts, Inc.; HG Timeline (internet reference); Feb. 20, 2006; 2 pages; www.henry-griffitts.com.

Henry-Griffitts, Inc.; Golf Training Center (internet reference); Feb. 20, 2006; 1 page; www.henry-griffitts.com.

Henry-Griffitts, Inc.; True Temper and Henry-Griffitts Team Up to Produce Breakthrough Clubfitting System (internet reference); Feb. 20, 2006; 1 page; www.truetemper.com.

* cited by examiner

UNIVERSAL SHAFT AND HEAD CONNECTOR

CROSS-REFERENCE TO RELATED PATENT APPLICATIONS

This patent application is a Divisional of co-pending U.S. patent application Ser. No. 12/353,304, filed Jan. 14, 2009, which application claims the benefit of U.S. Provisional Patent Application No. 61/020,793, filed Jan. 14, 2008, the entire teachings and disclosure of which are hereby incorporated in their entireties by reference thereto.

FIELD OF THE INVENTION

This invention generally relates to interchangeable golfing equipment and, more particularly, to a specific connection method for quickly securing any brand of golf club shaft and golf club head to one another.

BACKGROUND OF THE INVENTION

The typical way to connect a golf club shaft and a golf club head is to epoxy the tip end of the golf club shaft into a bore formed within the hosel portion of the golf club head. Many golf shops offer a broad range of exotic shafts and club heads to meet the standards of today's demanding golfer.

To facilitate the ease in which various combinations of shafts and heads may be evaluated by the golfer, some golf equipment makers, such as Callaway, Nike Golf, Alpha Golf, Taylor Made, Nakashima, and Versus Golf have devised connectors that rapidly secure a shaft and a club head together. Because these connectors are releasable, if the customer doesn't like the existing shaft and head combination the connector is simply released and a different shaft and head combination is secured for evaluation by the golfer.

Unfortunately, the known connectors designed by the companies mentioned above have significant deficiencies. For example, with the known connectors both the connector itself and the tip end of the shaft are received within the bore in the hosel portion of the golf club head. In order to accommodate the connector and the tip end of the shaft, these manufactures must design a specific golf club head with a hosel portion and bore that are significantly larger than industry standard. Therefore, industry standard components cannot be used to assemble a golf club without adopting the connection system of a particular company. In addition, any golf club head that has been designed as noted above will not receive connection devices designed by other manufactures.

There exists, therefore, a need in the art for a connector for shafts and heads that does not require the use of a custom golf club head with a larger hosel portion. The invention provides such a connector. These and other advantages of the invention, as well as additional inventive features, will be apparent from the description of the invention provided herein.

BRIEF SUMMARY OF THE INVENTION

A universal connector that releasably couples a golf club shaft and a golf club head within a hosel with a standard bore size is provided. The connector couples the shaft and head without the need to alter or custom design the hosel of the golf club head. The connector allows golf shops, retailers and consumers to instantly customize a club without the need of a repair technician. The product described herein is different because it adapts to any type of shaft or club head and is the only universal connection device in the marketplace. Also, it can be removed at any time without damage to the shaft or the golf club head and each component may be re-assembled using the standard components.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
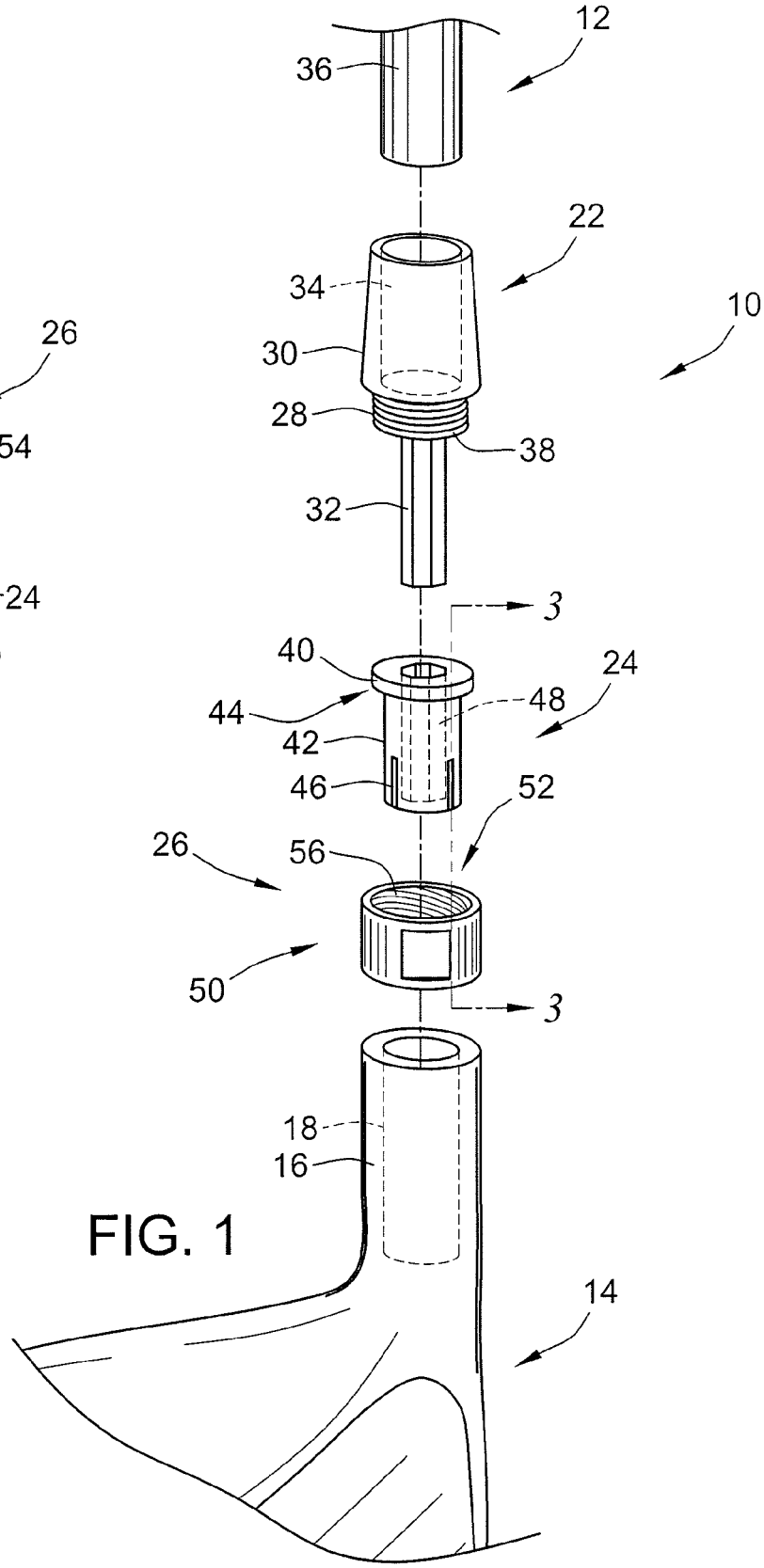
FIG. 1 is an exemplary embodiment of a connector in accordance with the teachings of the present invention.
Figure 2:
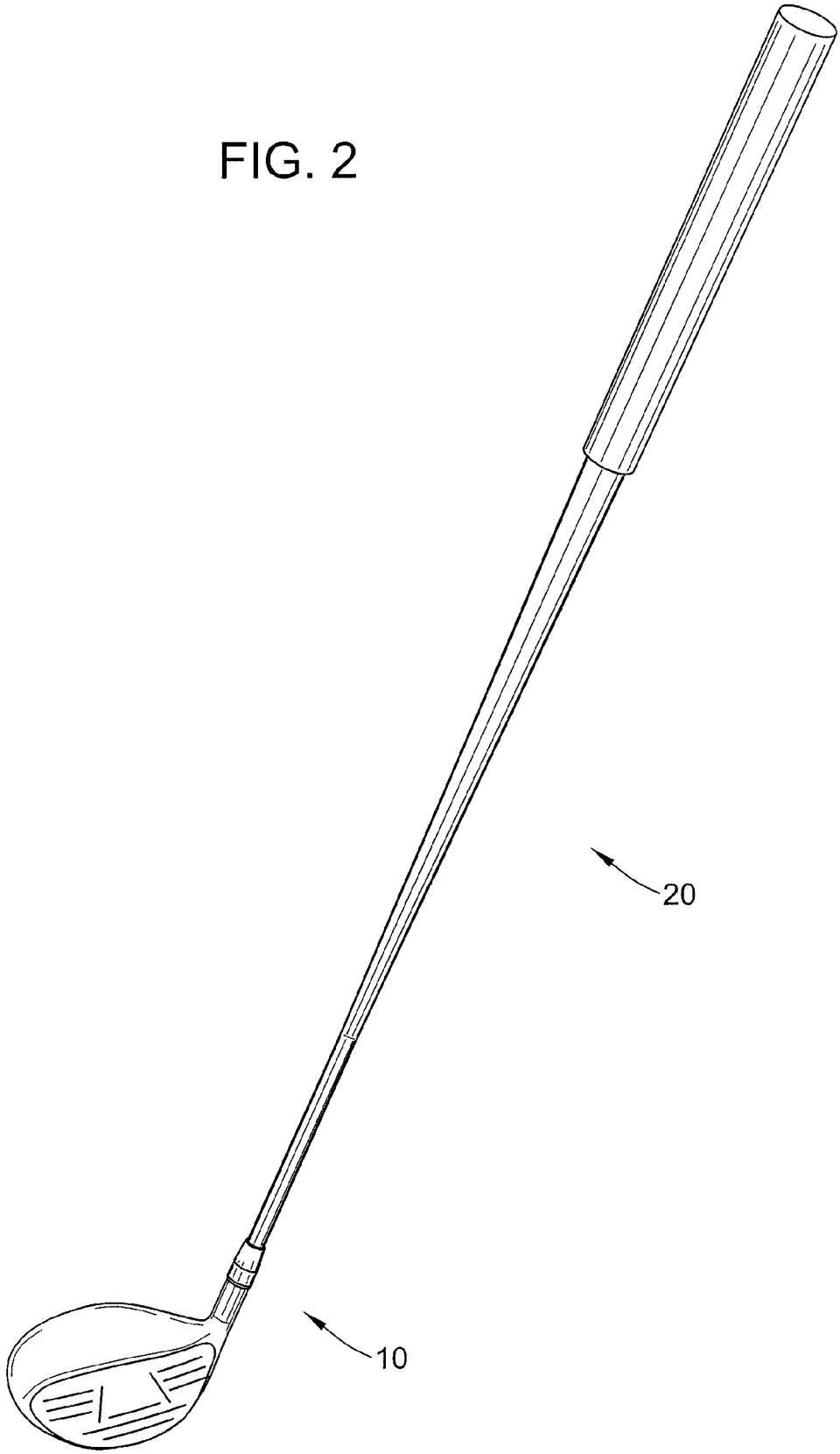
FIG. 2 is a golf club formed using the connector of FIG. 1.

Referring to FIG. 1, a universal shaft and head connector 10. As will be more fully explained below, the connector 10 is employed to operatively couple and secure a golf club shaft 12 with a golf club head 14 that has a hosel 16 with a standard sized bore 18 formed therein to form an assembled golf club 20 as shown in FIG. 2. The connector 10 couples the shaft 12 and head 14 without the shaft extending into the standard sized bore 18 of the hosel 16. As shown in FIG. 1, the connector 10 comprises a shaft adapter 22, a hosel adapter 24, and a compression nut 26.

The shaft adapter 22 includes an intermediate portion 28 interposed between a frustoconical portion 30 and a shaft portion 32. The shaft adapter 22, and in particular the frustoconical portion 30, includes a cylindrical bore 34 sized and dimensioned to receive the tip end 36 of the golf club shaft 12. If desired, the bore 34 may extend down into the intermediate portion 28 as well as the frustoconical portion 30. To correspond with the diameter of the standard golf club shaft 12, the bore 34 typically has an inner diameter of either 0.335, 0.350, 0.370, or 0.410 of an inch. Even so, the bore 34 may have other diameters to suitably accommodate shafts of other sizes. In the illustrated embodiment of FIG. 1, the outer diameter of the frustoconical portion 30 adjacent the intermediate portion 28 is generally equal to the outer diameter of the hosel 16 adjacent the open end of the bore 18. As such, the fully assembled golf club 20 of FIG. 2 is aesthetically pleasing.

Still referring to FIG. 1, the intermediate portion 28 is generally cylindrical and provided with a set of threads 38. Adjacent the intermediate portion 28, the shaft portion 32 is generally axial and, when viewed from below, has a hexagonal shape. Even so, the shaft portion 32 may have a variety of other suitable shapes such as, for example, square, oval, star-shaped, or some other non-circular shape. In the illustrated embodiment, the shaft portion 32 has an outer diameter that is less than the outer diameter of the intermediate portion 28. In the illustrated embodiment of FIG. 1, the shaft adapter 22 is unitarily formed. The shaft adapter 22 is formed from any of a variety of different suitable materials such as, for example, stainless steel, aluminum, metal alloys, plastic, and the like.

The hosel adapter 24 includes an annular flange 40 and a body portion 42. As shown in FIG. 1, the outer diameter of the annular flange 40 is wider than the outer dimension of the body portion 42. As such, a shoulder 44 is formed where the annular flange 40 and the body portion 42 intersect. The body portion 42 typically has an outer diameter of either 0.335, 0.350, 0.370, or 0.410 of an inch. Therefore, the outer diameter of the body portion 42 corresponds to the size of the bore 18 in the hosel 16 of the golf club head 14.

In the illustrated embodiment of FIG. 2, the body portion 42 of the hosel adapter 24 includes one or more slots 46. The slots 46 are configured to receive an epoxy or other adhesive therein. The slots 46 may be formed in the outer surface of the body portion 42 in a variety of different configurations such as, for example, an axial, circular, or helical pattern.

The hosel adapter 24 includes a bore 48 sized and dimensioned to receive the shaft portion 32 of the shaft adapter 22. In the illustrated embodiment of FIG. 1, the bore 48 has a hexagonal shape to correspond to the hexagonal shape of the shaft portion 32. Even so, the bore 48 may have a variety of other suitable shapes that correspond to the shape of the shaft portion 32. Like the shaft adapter 22, the hosel adapter 24 is formed from any of a variety of different suitable materials such as, for example, stainless steel, aluminum, metal alloys, plastic, and the like.

As shown in FIG. 2, the compression nut 26 is generally cylindrical in shape. An outer surface of the compression nut 26 includes a gripping structure 50 that permits the compression nut to be conveniently rotated relative to the shaft adapter 22, as will be more fully explained below. In the illustrated embodiment of FIG. 2, the gripping structure 50 is depicted as a knurl pattern and a wrench flat. While not shown, an additional wrench flat is included on the opposing side of the compression nut. Despite the gripping structure 50 shown, other gripping structures may also be suitably employed. In the illustrated embodiment of FIG. 1, the compression nut 26 is unitarily formed. The compression nut 26 is formed from any of a variety of different suitable materials such as, for example, stainless steel, aluminum, metal alloys, plastic, and the like.

Figure 3:
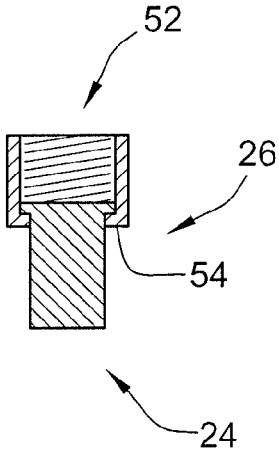
FIG. 3 is a cross section of the hosel adapter and compression nut from the connector of FIG. 1 taken generally along line 3-3.

The compression nut 26 includes a passage 52 that extends axially therethrough. As shown in FIG. 3, the size of the passage 52 proximate the bottom of the compression nut 26 is reduced in size by an inwardly directed flange 54. As shown in FIG. 3, the inwardly directed flange 54 prevents the hosel adapter 24 from passing entirely through the compression nut 26. In particular, when the hosel adapter 24 is received within the passage 52 of the compression nut 26 the upper surface of the inwardly directed flange 54 engages the shoulder 44 on the hosel adapter 24. Even so, the body portion 42 of the hosel adapter 24 is allowed to project beyond the bottom surface of the compression nut 26.

As shown in FIGS. 2 and 3, an inner surface of the compression nut 26 includes a set of threads 56. The threads 56 are configured to mate with the threads 38 formed on the intermediate portion 28 of the shaft adapter 22. Therefore, when the compression nut 26 is rotated relative to the shaft adapter 22, the compression nut and the shaft adapter 22 are releasably threadably coupled to each other. To uncouple the shaft adapter 22 from the compression nut 26, the compression nut is rotated in the opposite direction.

To form the assembled golf club of FIG. 2, the hosel adapter 24 is potted within the compression nut 26 as shown in FIG. 3. Thereafter, an adhesive (e.g., epoxy) is applied to the outer surface of the body portion 42 of the hosel adapter 24 and/or injected into the bore 18 in the hosel 16. Thereafter, the body portion 42 of the hosel adapter 24 is inserted into the bore 18 in the hosel 16 and the epoxy is allowed to sufficiently harden (e.g., dried, cured, etc.). In addition, an epoxy is also applied to the tip end 36 of the shaft 12 and/or injected into the bore 34 in the shaft adapter 22. Thereafter, the tip end 36 of the shaft 12 is inserted into the bore 34 in the shaft adapter 22 and the adhesive is allowed to sufficiently harden.

With the hosel adapter 24 secured in the bore 18 of the hosel 16 and the tip end 36 of the shaft 12 secured in the bore 34 of the shaft adapter 22, the shaft portion 32 of the shaft adapter 22 is inserted into the bore 48 in the hosel adapter 24. Because the shaft portion 32 and the bore 48 have corresponding non-circular shapes, relative rotation between the shaft adapter 22 and the hosel adapter 24 is prevented. Thereafter, the compression nut 26 is rotated by hand or with a suitable tool until the threads 38, 56 engage with each other. As rotation is continued, the hosel adapter 24 and the shaft adapter 22 are drawn tightly together and the golf club 20 as shown in FIG. 2 is assembled. In this assembled state, the tip end 36 of the shaft 12 is not received within or extend into the bore 18 of the hosel 16. Therefore, a conventional golf club head 14 with a bore 18 of standard size may be used instead of a customized golf club head with a larger or bored out hosel.

To disassemble the golf club 20 of FIG. 2, the compression nut 26 is rotated in a direction opposite that noted above until the threads disengage from each other. With the threads 38, 56 no longer mated, the shaft portion 32 is removed from the bore 48 in the hosel adapter 24 to uncouple the shaft 12 from the head 14.

In order to try out and test different combinations of shafts 12 and heads 14 where each shaft and head is equipped with a shaft adapter 22 and a hosel adapter 24, respectively, the above noted process of coupling and uncoupling is repeated. In this manner, shafts 12 and heads 14 of different sizes, from different manufacturers, of different materials, and the like may be repeatedly coupled, tested, and then uncoupled if the results are not satisfactory. If, however, the combination is satisfactory, the golf club 20 may be ordered from a retailer, sold, or used in play on a golf course.

From the foregoing, the connector 10 permits a quick, easy and convenient way for consumers, retailers, and others to try, test, and use different shafts 12 and heads 14 of standard or conventional size and configuration. As those skilled in the art will now appreciate from the above disclosure, the connector 10 permits interchangeability of shafts and heads without having to employ heads of non-standard dimension.

The threading on the shaft adapter may also optionally include a thread locking material such as a nylon patch that prevents vibration from releasing the threaded connection between the compression nut and the shaft adapter.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method of assembling a golf club, comprising:

providing a golf club head;

providing a golf club shaft;

arranging a compression nut generally in a region of interface between the golf club head and the golf club shaft, the compression nut having first threading and freely rotatable relative to the golf club head and the golf club shaft;

arranging a second threading on at least one of the golf club shaft and the golf club head;

freely rotating the compression nut relative to the golf club head and the golf club shaft; and drawing the golf club head and the golf club shaft together by said freely rotating.

2. The method of claim 1, further comprising:

securing a head adapter to the golf club head;

securing a shaft adapter to the golf club shaft;

facilitating linearly translation without rotation between the shaft and head adapters along an anti-rotation slide interface between the adapters during said drawing.

3. The method of claim 2, further comprising:

axially spacing the shaft outside of a hosel of the golf club head in a fully assembled state.

4. The method of claim 3, further comprising:

providing a thread lock material on at least one of the threadings;

preventing release of the adapters from each other due to said thread lock on threading.

5. The method of claim 2, further comprising:

axially spacing the shaft outside of a hosel of the golf club head in a fully assembled state.

6. The method of claim 3, further comprising:

providing a thread lock material on at least one of the threadings;

preventing release of the adapters from each other due to said thread lock on threading.

7. A method of assembling a golf club having a shaft and a golf club head, comprising:

providing a shaft adapter mounted on the shaft, the shaft adapter including a shaft bore in which the shaft is installed, a first threaded coupling member, and a first anti-rotation interface element extending away from the first threaded coupling member toward the golf club head;

providing a hosel adapter mounted into a hosel of the golf club head, the hosel adapter having a second anti-rotation interface element adapted to engage with the first anti-rotation element;

retaining a compression nut to the golf club head with the hosel adaptor, the compression nut having internal threads adapted to mate with the first threaded coupling member and being rotatable relative to the hosel adaptor;

freely rotating the compression nut relative to the golf club head and the golf club shaft;

drawing the golf club head and the golf club shaft together by said freely rotating; and engaging the first and second anti-rotation interface elements to prevent relative rotation between the shaft and the golf club head.

8. The method of claim 7, further comprising: facilitating linearly translation without rotation between the shaft and head adapters along an anti-rotation slide interface between the adapters during said drawing.

9. The method of claim 7, wherein the hosel adapter includes an annular flange extending radially outward from a main body portion, with the main body portion extending from the flange into the bore of the hosel, and wherein the compression nut includes a threaded sleeve portion and an annular flange extending radially inward from the sleeve portion, the annular flange of the compression nut sandwiched and trapped between the annular flange of the hosel adapter and the hosel of the head.

10. The method of claim 9, further comprising:

bonding an inner periphery of the hosel to an outer peripheral surface the main body portion.

11. The method of claim 10, wherein the mounting of the hosel adapter is accomplished without modifying an internal surface of the hosel.

12. The method of claim 7, wherein the shaft adapter includes a shaft sleeve portion receiving the shaft and an intermediate portion between the first anti-rotation interface element and the shaft sleeve portion, the intermediate portion having external threading mating with internal threading defined by the compression nut.

13. The method of claim 12, further comprising:

bonding an inner periphery of the shaft sleeve portion to an outer peripheral surface of the shaft.

14. The method of claim 7, wherein the shaft adapter includes a shaft sleeve portion receiving the shaft and an intermediate portion between the first anti-rotation interface element and the shaft sleeve portion, the intermediate portion having external threading mating with internal threading defined by the compression nut, wherein the hosel adapter includes an annular flange extending radially outward from a main body portion, with the main body portion extending from the flange into the bore of the hosel, and wherein the compression nut includes a threaded sleeve portion and an annular flange extending radially inward from the sleeve portion, the annular flange of the compression nut sandwiched and trapped between the annular flange of the hosel adapter and the hosel of the head, and wherein the shaft bore defines a diameter for receiving the shaft of between 0.3 and 0.45 of an inch, and wherein the main body portion also defines a diameter for insertion into the hosel of between 0.3 and 0.45 of an inch.

15. A method of assembling a golf club, comprising:

providing a golf club head;

providing a golf club shaft;

arranging a compression nut generally in a region of interface between the golf club head and the golf club shaft, the compression nut having first threading and freely rotatable relative to the golf club head and the golf club shaft;

installing a shaft adaptor on the golf club shaft with the golf club shaft received into a sleeve portion on the shaft adaptor;

installing hosel adaptor into the hosel of the golf club head;

freely rotating the compression nut relative to the golf club head and the golf club shaft; and drawing the golf club head and the golf club shaft together by said freely rotating.

16. The method of claim 15, utilizing tool engagement surfaces on compression nut to rotate the compression nut relative to the golf club head and the golf club shaft.

17. The method of claim 15, further comprising spacing the threads on the shaft adaptor in spaced relation to the sleeve portion, and retaining the compression nut to the hosel adaptor.

18. The method of claim 17, further comprising engaging between the hosel adaptor and the shaft adaptor along a slide interface between the first and the second adapters such that when the golf club head and golf club shaft are fully drawn together the slide interface prevents rotation between the golf club head and the golf club shaft.

19. The method of claim 15, wherein no part of the golf club shaft is received into the hosel.

* * * * *